US005287715A

United States Patent [19]

Kusaba

[11] Patent Number: 5,287,715

[45] Date of Patent: Feb. 22, 1994

[54] METHOD OF ROLLING STEEL SHAPES AND APPARATUS THEREFOR

[75] Inventor: Yoshiaki Kusaba, Kobe, Japan

[73] Assignee: Sumitomo Metal Industries, Ltd., Osaka, Japan

[21] Appl. No.: 830,232

[22] Filed: Jan. 31, 1991

[30] Foreign Application Priority Data

Feb. 8, 1991 [JP] Japan ..... 3-018023

[51] Int. Cl.[5] ..... B21B 1/08

[52] U.S. Cl. ..... 72/225; 72/229; 72/366.2

[58] Field of Search ..... 72/225, 229, 235, 366.2

[56] References Cited

U.S. PATENT DOCUMENTS

| | | | |
|---|---|---|---|
| 4,637,241 | 1/1987 | Michaux | 72/229 |
| 4,791,799 | 12/1988 | Engel et al. | 72/229 |
| 4,958,509 | 9/1990 | Kusaba et al. | 72/225 |
| 5,009,094 | 4/1991 | Hayashi et al. | 72/225 |
| 5,020,354 | 6/1991 | Kosak et al. | 72/229 |
| 5,031,435 | 7/1991 | Seto et al. | 72/247 |

FOREIGN PATENT DOCUMENTS

| | | | |
|---|---|---|---|
| 63-52701 | 3/1988 | Japan . | |
| 0092408 | 4/1990 | Japan | 72/252.5 |

*Primary Examiner*—Lowell A. Larson
*Assistant Examiner*—Thomas C. Schoeffler
*Attorney, Agent, or Firm*—Burns, Doane, Swecker & Mathis

[57] ABSTRACT

A method and apparatus for rolling parallel-flange steel shapes under hot conditions through reversing rolling in a universal mill group are disclosed. The mill group comprises a first universal mill, an edging mill, and a second universal mill. The web height of the steel shape is finished to a final target size by a final pass in the second universal mill, or the inner web length is finished to a final target size by reducing the web weight by a first pass in the first universal mill before carrying out the reversing rolling.

12 Claims, 4 Drawing Sheets

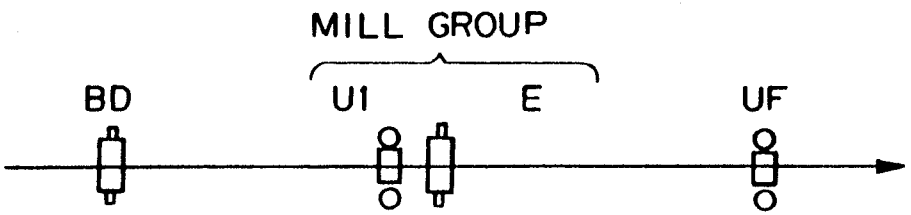
Fig. 3 "PRIOR ART"
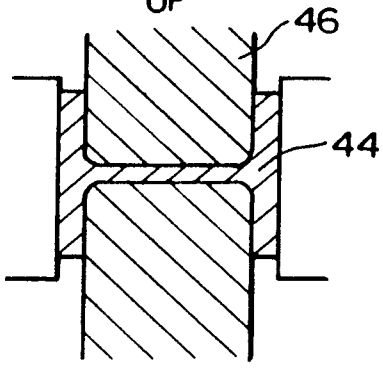
Fig. 4b "PRIOR ART" UF
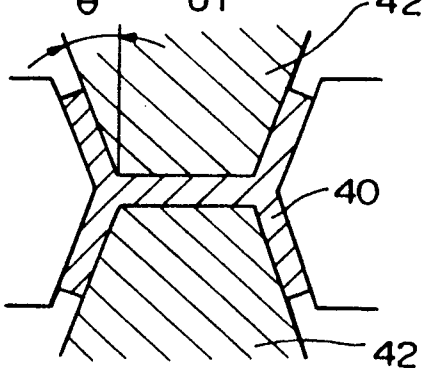
Fig. 4a "PRIOR ART" U1

"PRIOR ART"

"PRIOR ART"

"PRIOR ART"

METHOD OF ROLLING STEEL SHAPES AND APPARATUS THEREFOR

The present invention relates to a method and apparatus for rolling parallel-flange steel shapes, such as H-shaped beams and square tube-holding channels, for use in civil engineering and the construction industry.

A conventional rolling mill line for producing H-shaped beams and channels which have parallel flanges comprises, as shown in FIG. 3, three different types of mills: a 2-high breakdown mill (hereunder referred to as a "BD-mill"), a universal roughing mill group including a universal roughing mill (hereunder referred to as a "U1-mill") and a 2-high edging mill (hereunder referred to as an "E-mill"), and a universal finishing mill (hereunder referred to as a "UF-mill"). The BD-mill, U1-mill +E-mill, and UF-mill are arranged in a tandem line in this order. The roughing mill group comprising the U1-mill and E-mill is preferably placed separately from the UF-mill, since reversing type tandem rolling is carried out in the roughing mill group.

FIGS. 4*a* and 4*b* are schematic sectional views explaining rolling with the U1-mill and UF-mill, respectively.

Generally, as shown in FIG. 4*a*, the U1-mill is used for rolling a work piece 40 through reversing type rolling. As a result, there is significant wear of the opposite lateral faces of each of horizontal rolls 42. For example, when a 1500-ton lot of a rolling material is rolled, the width of the horizontal roll 42 is usually reduced by 1.5–2.0 mm due to wear. This means that the amount of wear of the roll width reaches roughly 4 mm when the above-described rolling is carried out twice. On the other hand, the allowance of the web height is plus and minus 2 mm, and steel shapes produced using such a worn roll do not meet the allowance.

Thus, when the taper ($\theta$) of each of the lateral faces of a horizontal roll 42 is zero, a surface of the horizontal roll is worn markedly during rolling, and it is impossible to restore the horizontal roll to a given width by machining the roll. The number of rolled products which can be manufactured with one set of rolls is limited to an extremely small number, resulting in a great increase in roll inventory costs.

In order to avoid such disadvantages, the horizontal rolls 42 of the U1-mill has tapered lateral faces as shown in FIG. 4*a*. Usually, the lateral faces of the rolls 42 are tapered at an angle of 3–5 degrees and rolling is carried out using a horizontal roll which has an increasingly enlarged width toward the axis of the roll, i.e., a trapezoid in section. This is because the central portion of a horizontal roll 42 is usually subjected to severe wearing during rolling.

Therefore, even when machining of the roll is carried out after rolling, the width of the horizontal roll is ensured not to be smaller than a predetermined amount.

As shown in FIG. 4*b*, since the angle between the web and flange is 90 degrees for a final product, i.e., steel shapes including H-shaped steel, a work piece 44 which has been rolled with horizontal rolls 42 having tapered lateral faces is further rolled by a single pass through the UF mill having horizontal rolls 46 with upright sides ($\theta=0$), which is positioned downstream of and remote from the U1-mill, as shown in FIG. 3. This is because reversing type tandem rolling is carried out in the roughing mill group, and this is why the UF-mill is placed remote from the roughing mill group. An increase in the length of the rolling shop building is inevitable.

Thus, according to the conventional rolling method shown in FIG. 3 it is necessary to arrange the BD-mill, U1-mill+E-mill, and UF-mill in a tandem line in which the UF-mill is positioned remote from the roughing mill group, and the length of a rolling shop extends for a total of several hundred meters. Therefore, the costs of a building for housing the rolling shop and the costs of all the rolls are inevitably very high.

In order to carry out rolling of parallel-flange shapes more efficiently than by a conventional method shown in FIG. 3 while using a rolling shop of the same length, a mill layout such as shown in FIG. 5 has been proposed. In this layout, a conventional U1-mill is divided into two mills, i.e., a U1-mill and a U2-mill to achieve a rolling mill arrangement including a BD-mill, a U1-mill+E-mill+U2-mill (universal roughing mill group), and a UF-mill. However, such a rolling mill arrangement can not increase the rolling efficiency remarkably, nor can it decrease the length of the rolling shop building.

Furthermore, in order to shorten the length of the rolling shop building as well as to achieve more efficient rolling using the same number of rolling mills as shown in FIG. 3, a rolling mill layout for reversing type tandem rolling which includes the BD-mill, U1-mill, E-mill, and UF-mill, such as shown in FIG. 6, has been proposed. See Japanese Patent Application Laid-Open Specification No. 52701/1988. The horizontal rolls for use in the U1-mill of this rolling mill arrangement have lateral faces tapered at 3 degrees or larger so as to compensate for wear of the roll.

According to a rolling method using the above-proposed rolling mill arrangement, as shown in FIG. 6, reversing type rolling is carried out through a universal roughing mill group including the U1-mill, E-mill, and UF-mill, and the taper of the flange is varied, for example, from 3 degrees to zero, and then from zero to 3 degrees when the rolling work piece is rolled in each of the rolling mills. Thus, the flanges are subjected to bending in each pass. There is no problem when the taper of the flange is varied from 3 degrees to zero in the UF-mill. However, when the taper is varied from zero to 3 degrees in the U1-mill 70, as shown in FIG. 7, since the width of the horizontal rolls 72 is larger than the inner width of the web 74 of the rolling work piece 76, the rolling is carried out in such a manner that the inner surfaces of the flanges 78 are expanded by the lateral faces of the horizontal roll 72. 80 indicates vertical rolls. Thus, formation of rolling defects easily occurs on the inner surfaces of the flanges making this arrangement impractical.

In addition, it would be difficult to achieve highly efficient rolling due to less efficient rolling with the UF-mill, even if the horizontal rolls of the UF-mill have upright sides, since wear of the horizontal rolls having upright sides is much more severe when the same level of rolling load as in the U1-mill is applied to the UF-mill.

As is apparent from the foregoing it is impossible to shorten the length of a rolling shop building or to reduce the number of rolls when the tandem rolling mill layout illustrated in FIG. 3 is employed compared with the rolling mill layout shown in FIG. 5.

It is also impossible to achieve the same level of rolling efficiency as in the mill layout shown in FIG. 5 when the rolling mill layout shown in FIG. 3 is employed.

Formation of rolling defects on the inner surfaces of the flanges is inevitable due to the difference in taper on the horizontal roll of each mill so long as a conventional rolling mill arrangement including a U1-mill, an E-mill, and a UF-mill is used.

SUMMARY OF THE INVENTION

An object of the present invention is to provide a method and apparatus for rolling parallel-flange steel shapes free from rolling defects on the inner surfaces of the flanges using a rolling mill line comprising a BD-mill, a U1-mill+E-mill, and a UF-mill with a rolling efficiency of at least that achieved using a rolling mill line comprising a BD-mill, a U1-mill+E-mill+U2-mill, and a UF-mill.

The inventor of the present invention found that the above object can be achieved by establishing a precise target web height in the step of universal rough rolling in the U1-mill or universal finish rolling in the UF-mill, in which horizontal rolls of the variable-width type are used.

U.S. Pat. No. 4,958,509 to Kusaba et al. discloses a method of reducing the web height by using a universal mill in which the horizontal roll is divided into two halves to make the width of the roll variable. According to this method, the horizontal roll is divided into two segments, and the web height is reduced by rolling the outer surfaces of the flanges with vertical rolls in a universal finishing mill having variable-width horizontal rolls without the inner surfaces of the flanges contacting the lateral surfaces of the horizontal rolls.

The present inventor found that it is possible to produce parallel-flange shapes highly efficiently with a compact rolling mill and it is also possible to produce parallel-flange channels having a given length of web height using a working universal mill group comprising a first universal mill, an edging mill, and a second universal mill by means of either of the following.

(1) Reversing type rolling is carried out through the above-described universal mill group and the web height is finished to a final target size by the final pass in the second universal mill after carrying out reversing type rolling.

(2) The inner web length is finished to a final target size by reducing the web height by the first pass in the first universal mill in which each of the horizontal rolls has a fixed width, and then the web height is varied by carrying out reversing type rolling in the universal mill group.

The first universal mill may correspond to a U1-mill and the second universal mill may correspond to a UF-mill of the conventional mill arrangement. The horizontal rolls of each of the U1-mill, E-mill, and UF-mill may have upright lateral faces, and the first universal mill and the second universal mill may be operated under the same rolling conditions with respect to reduction.

Thus, the present invention provides a method of rolling parallel-flange steel shapes in which reversing rolling is carried out in a universal mill group comprising a first universal mill, an edging mill, and a second universal mill under hot conditions, characterized in that the horizontal rolls of the second universal mill are of the variable-width type, and the web height of the steel shape is finished to a final target size by a final pass in the second universal mill.

In another aspect, the present invention provides a method of rolling parallel-flange steel shapes in which reversing rolling is carried out in a universal mill group comprising a first universal mill, an edging mill, and a second universal mill under hot conditions, characterized in that the horizontal rolls of the first universal mill are of the variable-width type, and the inner web length is finished to a final target size by reducing the web height by the first pass in the first universal mill before carrying out the reversing rolling.

In still another aspect, the present invention provides an apparatus for rolling parallel-flange steel shapes, which comprises a first universal mill, an edging mill, and a second universal mill in a tandem arrangement, characterized in that the first universal mill, edging mill, and second universal mill constitutes a universal mill group in which reversing rolling is carried out, either one of the first or second universal mills contains variable-width horizontal rolls, the other remaining mill contains fixed-width horizontal rolls.

Preferably, the edging mill may contain horizontal rolls of the variable-width type.

In a preferred embodiment of the method of the present invention, the first universal mill and the second universal mill are operated under the same rolling conditions with respect to reduction by rolling.

In another preferred embodiment, the taper of the horizontal rolls of the first and second universal mill is from zero (inclusive) to 2.0 degrees (inclusive), and preferably from zero (inclusive) to 0.5 degrees (inclusive). When the taper is over 2.0 degrees, usually over 0.5 degrees, it is rather difficult to make flat the flanges of shapes after cooling.

It is also preferable that all the horizontal rolls of the first universal mill, the edging mill, and the second universal mill have lateral faces tapered at the same angle of zero to 2.0 degrees, preferably $\theta=0$.

BRIEF DESCRIPTION OF THE DRAWINGS

FIG. 3 is an illustration showing a mill layout of the prior art;

FIG. 4*a* is an illustration of rolling with a conventional U1-mill;

FIG. 4*b* is also an illustration of rolling with a conventional UF-mill;

DESCRIPTION OF THE PREFERRED EMBODIMENTS

Figure 1A:
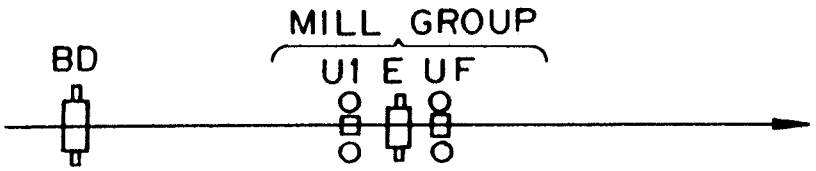
FIG. 1*a* is a schematic illustration of an apparatus for rolling parallel-flange steel shapes in accordance with the present invention.
Figure 1B:
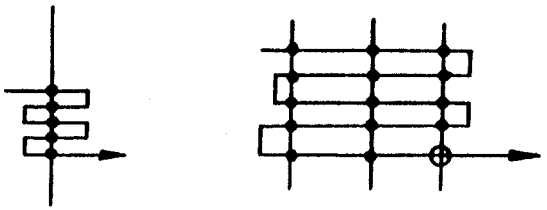
FIG. 1*b* is an illustration explaining the number of passes in the rolling.
Figure 1C:
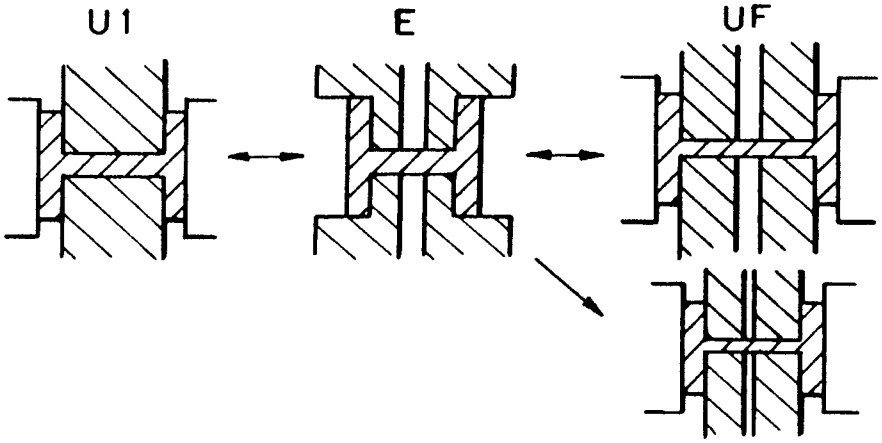
FIG. 1*c* is a schematic sectional view showing the structures of a U1-mill, an E-mill, and a UF-mill.

An example of a mill arrangement for producing parallel-flange steel shapes according to the present invention is illustrated in FIG. 1*a*. FIG. 1*b* shows the number of times reversing rolling is carried out. FIG. 1*c* shows a cross section of the structures of a first universal mill, an edging mill, and a second universal mill which correspond to and are hereunder referred to as a U1-mill, E-mill, and UF-mill, respectively.

As is apparent from FIG. 1*a*, a rolling apparatus of the present invention comprises a U1-mill, an E-mill, and a UF-mill, which are arranged close to each other to constitute a universal mill group in which reversing type rolling is carried out, resulting in a shortening of the length of a rolling shop building.

It is also apparent from FIG. 1*c* that the horizontal roll of the U1-mill may be a conventional one of the fixed width type, and the horizontal rolls of both the E-mill and UF-mill may be of the two-segment type in which each of the horizontal rolls is divided into two segments in the widthwise direction of the roll and the roll width can be varied without being detached.

In order to vary the width of the horizontal roll, as have been disclosed in Japan Utility-Model Registration Application No. 17997/1990, which corresponds to U.S. Ser. No. 645,502, now U.S. Pat. No. 5,154,074 two-segment roll sleeves are connected to an arbor with a sliding key, and after the position of each of the roll sleeves, i.e., the width of the horizontal roll is set by turning the arbor, each of the roll sleeves is fixed at the position by means of a locknut which is screwed to a connecting sleeve. The connecting sleeve is connected to the arbor via a clutch mechanism.

The width of a horizontal roll can also be adjusted as disclosed in U.S. Pat. No. 4,958,509.

Manufacture of H-Shaped Beams:

When an H-shaped beam having a dimension of H500×200×10/16, for example, is produced with a rolling mill arrangement shown in FIGS. 1*a* and 1*c*, the width of the horizontal roll of the U1-mill and UF-mill is set to be equal to 500−14×2=468 mm, which corresponds to the inner length of the web of the final rolled product in accordance with a conventional method.

However, according to the present invention it is possible to reduce the web height by 10 mm (maximum) in the final pass indicated by a white circle in FIG. 1*b*, and the width of the horizontal roll of U1-mill may be 468+10=478 mm. Horizontal rolls may be used repeatedly by machining the roll after rolling until the roll width reaches 468 mm in a final rolling operation. Namely, provided that the amount of machining is 2 mm after each rolling operation, the horizontal rolls of a universal mill can be used six times. According to the present invention, since the wear of the lateral faces of the horizontal rolls is markedly reduced compared with that of a conventional horizontal roll of the fixed width type, there is no need to provide a tapered lateral face with the horizontal roll, i.e., the taper of the lateral faces is from zero (inclusive) to 2.0 degrees (inclusive), preferably from zero (inclusive) to 0.5 degrees (inclusive).

In the embodiment shown in FIGS. 1*a*–1*c*, the horizontal rolls of the UF-mill are of the variable-width type. The width of the horizontal rolls is adjusted to be the same as that of the horizontal rolls of the U1-mill during rolling from the first pass to one pass before the final pass, and the width is changed to 468 mm for the final pass so as to produce H-shaped beams having a target dimension of H500×200×10/16.

It is also preferable that the edging roll of the E-mill shown in FIGS. 1*a* and 1*c* be of the variable-width type. It is important that the width of the edging roll be adjusted to be the same as that of the width of the horizontal rolls of the U1-mill so as to avoid buckling of the flanges, which is caused by the presence of a space between the inner surface of the flange and the lateral surface of the roll. However, it is costly to change the edging roll for each rolling operation so as to adjust the width thereof to be in conformity with the inner web width of the rolling work piece, because this causes an increase in inventory costs of edging rolls and an increasing need for more space to keep the rolls. Thus, it is preferable to use an edging roll the width of which can be varied.

According to the present invention it is possible to produce H-shaped beams free from rolling defects efficiently, since reversing type rolling in the universal mill group can be carried out under the same rolling conditions with respect to a reduction for the U1-mill and UF-mill from the first pass to one pass before the final pass, and the taper of the inner surfaces of the flanges is kept constant, usually so as to be zero. By the final pass in the UF-mill, in which the width of the horizontal roll is then adjusted to be a target length of the inner width of the web, a final product having a predetermined length of the web height can be obtained.

In another embodiment, the inner web length may be finished to a final target size by reducing the web height by a first pass in the first universal mill before carrying out the reversing rolling. In this case the horizontal rolls of the first universal mill are of the variable-width type.

Furthermore, it is preferable that the web height or the inner web length of the work is varied to a predetermined value by the final pass or the first pass, respectively, during the reversing rolling, and the taper of the lateral faces of the horizontal rolls of each of the U1-mill, the E-mill, and the UF-mill is the same.

In still another embodiment, the U1-mill and UF-mill may be operated under the same rolling conditions with respect to reduction.

In the above explanation the U1-mill has horizontal rolls of the fixed-width type and the UF-mill has horizontal rolls of the variable-width type. It is also within the scope of the present invention to use a rolling mill arrangement in which the U1-mill employs horizontal rolls of the variable-width type and the UF-mill employs horizontal rolls of the fixed-width type.

Manufacture of Steel Channels:

A rolling process for producing steel channels having a given outer web height in accordance with the present invention will now be described.

Figure 2A:
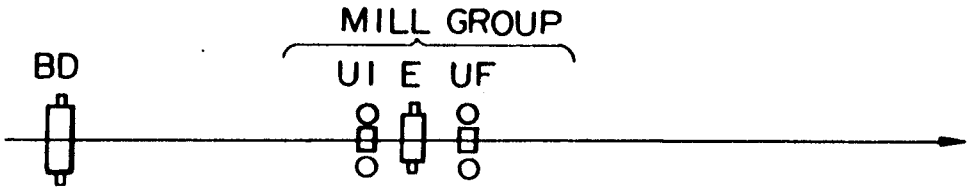
FIG. 2*a* is a schematic illustration of another apparatus in accordance with the present invention.
Figure 2B:
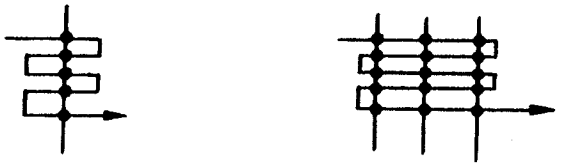
FIG. 2*b* is an illustration explaining the number of passes in the reverse rolling.

It is possible in this case, too, for the horizontal rolls of the UF-mill to be of the variable-width type and for the web height to be finished to a final target size through the finishing rolling in the second universal mill. However, the present invention will be described in conjunction with another embodiment in which, as shown in FIGS. 2*a*–2*c*, the horizontal rolls of the U1-mill are of the variable-width type and the horizontal rolls of the UF-mill are of the fixed-width type.

When a steel shape having a web 50 mm or more thick is rolled, the rolling load in the final pass through the UF-mill having horizontal rolls of the variable-width type is increased markedly, and sometimes the rolling load goes over an upper limit for the universal mill, making rolling impossible. Thus, in order to reduce the rolling load applied to the horizontal rolls of the variable-width type, as shown in FIGS. 2a–2c, the horizontal rolls of the U1-mill are of the variable-width type and the horizontal rolls of the UF-mill are of the fixed-width type. The width of the horizontal rolls of the U1-mill is set to be in conformity with a final target size of the inner web width, i.e., inner web length, and the width of the horizontal roll of the UF-mill is set to be in conformity with the smallest size among the inner width sizes which are rolled by one rolling operation. In addition, the inner web width of the rolling work piece transported from the BD-mill is adjusted to be the largest one among the sizes which are rolled by one rolling operation.

Figure 2C:
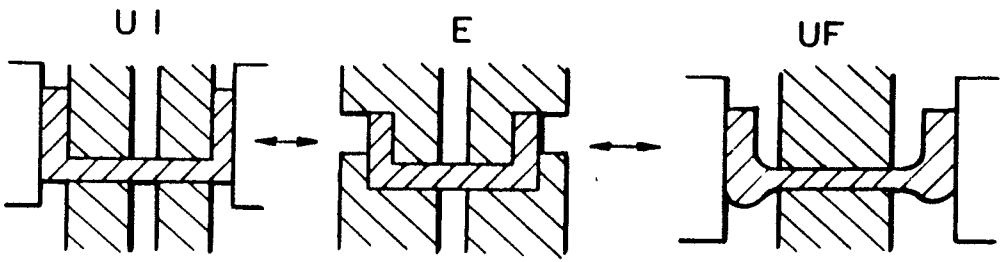
FIG. 2*c* is a schematic sectional view showing the structures of a U1-mill, an E-mill, and a UF-mill.
Figure 5:
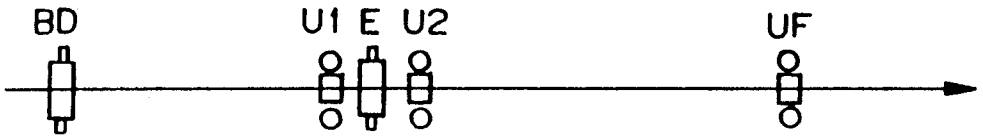
FIG. 5 is an illustration showing a conventional, efficient rolling mill layout.
Figure 6:
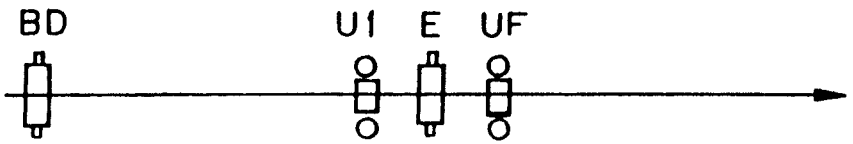
FIG. 6 is a schematic illustration of a rolling apparatus comprising an U1-mill, an E-mill, and a UF-mill in a tandem arrangement.
Figure 7:
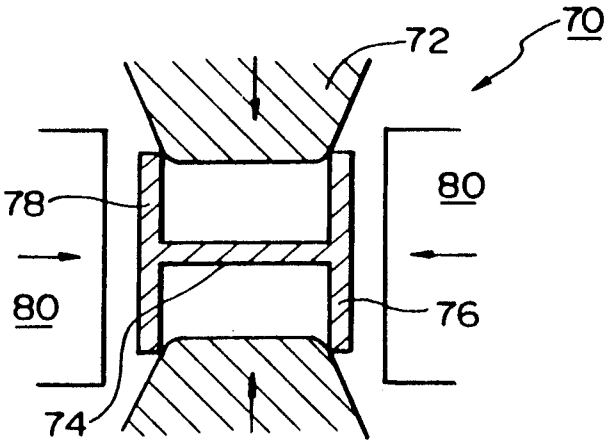
FIG. 7 is a schematic illustration showing the occurrence of rolling defects when reversing rolling is carried out in the UF-mill and U1-mill in accordance with a conventional rolling process.

As shown in FIG. 2c, in the first pass through the group of the universal rolling mills the web is rolled with the horizontal rolls of the U1-mill and the web height is reduced with the uniform diameter cylindrical surfaces of the vertical rolls to adjust the inner web length of the work to be the same as a final target size of the inner web length. Then, in the universal mill group comprising the U1-mill, the E-mill, and the UF-mill, reversing type rolling is carried out so as to effect a reduction in flange and web thickness.

The width of the horizontal rolls of the UF-mill is smaller than that of the horizontal rolls of the U1-mill.

In a preferred embodiment, in the first half of the passes, reduction in the thickness of flanges is not carried out, but reduction in the thickness of web is effected. In the second half of the passes, reduction is not carried out markedly by the horizontal rolls and uniform diameter cylindrical surfaces of the vertical rolls of the UF-mill, although they contact the work piece. Thus, steel channels having a given outer web length, i.e., web height can be produced through reversing rolling.

In order to produce various sizes of steel channels through the same rolling operation in which the inner web length changes in accordance with the size of the work piece, it is preferable to change the width of the edging rolls of the E-mill depending on the size of the work piece, and it is preferable to use an E-mill in which the width of the rolls is variable.

Furthermore, it is preferable that the web height or the inner web length of the work is varied to a predetermined value by the final pass or the first pass, respectively, during the reversing rolling and the taper of the lateral faces of each of the horizontal rolls of each of the U1-mill, the E-mill, and the UF-mill is the same.

The present invention will be further described by some working examples which are presented merely for illustrative purposes.

EXAMPLE 1

In this example H-shaped beams measuring H500×200×10/16 were produced in the rolling mill line shown in FIGS. 1a–1c in accordance with the present invention.

As a conventional method, the same H-shaped beams were rolled in the rolling mill line shown in FIG. 3, which comprised a BD-mill, a U1-mill+E-mill, and a UF-mill. In this conventional method a continuous cast slab (300 mm thick×700 mm wide) was rolled by 15 passes through the BD-mill, 11 passes through the rough rolling mill group, and 1 pass through the UF-mill. The number of passes through each of the rolling mills was determined so as to make the total time required for rolling equal in each mill so that the rolling efficiency was maximized.

Table 1 shows a pass schedule for the rough rolling mill group including the U1-mill and E-mill of the above-described conventional method. In this example a beam blank transported from the BD-mill had a web thickness of 60 mm.

In contrast, a continuous cast slab having the same dimension was rolled according to the method of the present invention.

If the above pass schedule is applied to the rolling method of the present invention, 15 passes should be carried out with the BD-mill, and 7 passes should be carried out with a rolling mill group of the U1-mill+E-mill+UF-mill. It is apparent that the BD-mill is a bottleneck to achieving efficient rolling.

Thus, in the rolling method of the present invention the web thickness of the beam blank supplied from the BD-mill was increased from 60 mm for the conventional to 80 mm, and the number of passes through the BD-mill was also reduced from 15 to 11. A reduction which had been achieved by 4 passes was effected by 7 passes in the universal mill group of the U1-mill+E-mill+UF-mill. The pass schedule of this example is shown in Table 2.

In this example, the web height was finished to a final target size by the final pass in the second universal mill, i.e., the UF-mill.

Thus, as is apparent from Table 2, H-shaped steels were produced by 11 passes with the BD-mill, and 7 passes in the group of universal rolling mills including the U1-mill, the E-mill, and the UF-mill. The rolling efficiency was improved by 40%, i.e., the number of rolling passes was decreased from 27 passes to 17 passes.

The life of the horizontal rolls of the U1-mill in the conventional process was two rolling operations of 3,000 tons with respect to H-shaped beams measuring H500×200. This means that wear of lateral faces of the horizontal rolls causes much reduction in the roll width.

According to the present invention, however, since the amount of reduction in web height, which can be achieved by the UF-mill having horizontal rolls of the variable-width type is 10 mm at maximum, the rolling operation for the UF-mill will be six operations, i.e., 9000 tons of steel shapes can be rolled. This means that in the past three sets of rolls in a given series of sizes were necessary, but according to the present invention only two sets of rolls of which one set is a spare one are sufficient, resulting in approximately a 30% decrease in the number of rolls achieved.

EXAMPLE 2

In this example steel channels of dimensions of 600×300×20, 600×300×30, and 600×300×40 (mm) were manufactured in the rolling mill line shown in FIGS. 2a–2c.

A beam blank supplied from a BD-mill had a dimension of 50 mm (web thickness)×60 mm (flange thickness). The inner web length of the beam blank was as large as that of the largest one, i.e., U600×300×20, and the width of the horizontal rolls of the universal mills was adjusted to be as small as that of the smallest one, U600×300×40.

Steel channels measuring U600×300×20 having the largest inner web length were manufactured. In this case, the inner web length was finished in the final pass in the BD-mill. The web thickness and the flange thickness were reduced mainly through the U1-mill. Only the web thickness was reduced through the UF-mill.

The pass schedule of this case is shown in Table 3.

On the other hand, when steel channels measuring U600×300×40 having the largest inner web length were manufactured, the inner web length was finished in the first pass in the U1-mill, and then the web thickness and flange thickness were reduced through the U1-mill and UF-mill.

The pass schedule of this case is shown in Table 4.

TABLE 1

(mm)

| Pass No. | Web Thickness | Flange Thickness | Web Height |
|---|---|---|---|
| | 60 | 108 | |
| 1 | 50 | 93 | |
| 2 | 40 | 77 | |
| 3 | 34 | 64 | |
| 4 | 28 | 54 | |
| 5 | 24 | 46 | |
| 6 | 21 | 38 | |
| 7 | 18 | 31 | |
| 8 | 15.4 | 26 | |
| 9 | 13.4 | 23 | |
| 10 | 11.7 | 19.6 | |
| 11 | 10.2 | 16.8 | |
| UF | 10.0 | 16.0 | 500 |

Horizontal Roll Width: U1 = 468 mm

TABLE 2

(mm)

| | U1 - mill | | | UF - mill | | |
|---|---|---|---|---|---|---|
| Pass No. | Web Thickness | Flange Thickness | Web Height | Web Thickness | Flange Thickness | Web Height |
| | 80 | 108 | | — | — | |
| 1 | 70 | 105 | | 60 | 102 | |
| 2 | 40 | 77 | | 50 | 93 | |
| 3 | 34 | 64 | | 28 | 54 | |
| 4 | 21 | 38 | | 24 | 46 | |
| 5 | 18 | 31 | | 15.4 | 26 | |
| 6 | 11.7 | 19.6 | | 13.4 | 23 | |
| 7 | 10.2 | 16.8 | 511.6 | 10.0 | 16.0 | 500 |

Horizontal Roll Width: U1 = 478 mm, UF478 mm → 468 mm (last pass)

TABLE 3

600 × 300 × 20 (Wo = 560 mm) (mm)

| | U1 | | | UF | | |
|---|---|---|---|---|---|---|
| Pass No. | Web Thickness | Flange Thickness | Inner Web Length (Wo) | Web Thickness | Flange Thickness | Inner Web Length (Wo) |
| | 50 | 60 | 560 | — | — | — |
| 1 | 40 | 48 | " | 40 | — | — |
| 2 | 32 | 36 | " | 32 | — | — |
| 3 | 26 | 28 | " | 26 | — | — |
| 4 | 22 | 23 | " | 22 | — | — |
| 5 | 20 | 20 | " | 20 | 20 | 560 |

TABLE 4

600 × 300 × 40 (Wo = 540 mm) (mm)

| | U1 | | | UF | | |
|---|---|---|---|---|---|---|
| Pass No. | Web Thickness | Flange Thickness | Inner Web Length (Wo) | Web Thickness | Flange Thickness | Inner Web Length (Wo) |
| | 50 | 60 | 560 | — | — | — |
| 1 | 50 | 60 | 540 | 50 | 60 | 540 |
| 2 | 43 | 46 | 540 | 46 | 52 | 540 |
| 3 | 41 | 42 | 540 | 40 | 40 | 540 |

What is claimed is:

1. A method of rolling parallel-flange steel shapes comprising steps of:

forming a parallel-flange steel shape by reversing rolling steel under hot conditions in a universal mill group comprising a first universal mill, an edging mill, and a second universal mill wherein the steel is sequentially rolled by each of the first universal mill, the edging mill and the second universal mill during the reversing step and horizontal rolls of the second universal mill are of the variable-width type and taper of lateral faces of the horizontal rolls and edging rolls are from 0 to 2.0 degrees for each of the first universal mill, edging mill and second universal mill; and finishing a web height of the steel shape to a final target size by a final pass in the second universal mill.

2. A method of rolling steel shapes as set forth in claim 1 wherein an inner web length of the steel shape is finished in the final pass by reducing the web height of the steel shape.

3. A method of rolling steel shapes as set forth in claim 1 wherein the edging mill is a variable-width type edging mill.

4. A method of rolling steel shapes as set forth in claim 1 wherein horizontal rolls of the first universal mill are of the fixed-width type, an inner web length of the steel shape is decreased in the final pass.

5. A method of rolling steel shapes as set forth in claim 1 wherein the steel shape is reduced by an equal amount in the first and second universal rolling mills.

6. A method of rolling steel shapes as set forth in claim 1 wherein the reversing rolling is carried out with an equal horizontal roll width in the first and second universal mills and in the edging mill.

7. A method of rolling steel shapes as set forth in claim 1 wherein the taper of the lateral faces of the horizontal rolls a taper of the edging roll are the same for the first universal mill, the edging mill, and the second universal mill.

8. A method of rolling steel shapes as set forth in claim 1 wherein the parallel-flange shapes are H-beams.

9. A method of rolling steel shapes as set forth in claim 1 wherein the parallel-flange shapes are channels.

10. A method of rolling steel shapes as set forth in claim 1, wherein the second universal mill includes vertical rolls, the vertical rolls having uniform diameter cylindrical surfaces which contact the steel shape during the finishing step.

11. A method of rolling steel shapes as set forth in claim 1, wherein the first universal mill includes vertical rolls, the vertical rolls having uniform diameter cylindrical surfaces which contact the steel shape during the forming step.

12. A method of rolling steel shapes as set forth in claim 11, wherein the second universal mill includes vertical rolls, the vertical rolls having uniform diameter cylindrical surfaces which contact the steel shape during the finishing step.

* * * * *

UNITED STATES PATENT AND TRADEMARK OFFICE

CERTIFICATE OF CORRECTION

PATENT NO. : 5,287,715

DATED : February 22, 1994

INVENTOR(S) : Yoshiaki KUSABA

It is certified that error appears in the above-indentified patent and that said Letters Patent is hereby corrected as shown below:

On title page, item [22], delete "1991" and insert --1992--

Signed and Sealed this

Fourteenth Day of June, 1994

Bruce Lehman

*Attest:*

BRUCE LEHMAN

*Attesting Officer*

*Commissioner of Patents and Trademarks*